US007617668B2

(12) United States Patent
Miura

(10) Patent No.: US 7,617,668 B2
(45) Date of Patent: Nov. 17, 2009

(54) METHOD OF PRODUCING POWER TRANSMISSION CHAIN AND PRESS-FITTING APPARATUS USED IN SAID METHOD

(75) Inventor: Yoshihisa Miura, Yamatokoriyama (JP)

(73) Assignee: JTEKT Corporation, Osaka (JP)

( * ) Notice: Subject to any disclaimer, the term of this patent is extended or adjusted under 35 U.S.C. 154(b) by 0 days.

(21) Appl. No.: 12/010,995

(22) Filed: Jan. 31, 2008

(65) Prior Publication Data

US 2008/0184692 A1 Aug. 7, 2008

(30) Foreign Application Priority Data

Feb. 1, 2007 (JP) ..... P2007-022575

(51) Int. Cl.
*F16G 13/06* (2006.01)
*B21L 9/06* (2006.01)

(52) U.S. Cl. ..... 59/8; 59/7; 59/35.1; 474/229; 29/251

(58) Field of Classification Search ..... 59/7, 59/11, 35.1, 8; 474/229, 230, 251; 29/525.01; 100/292

See application file for complete search history.

(56) References Cited

U.S. PATENT DOCUMENTS 2,831,316 A * 4/1958 Linde, Jr. ..... 59/7
3,866,410 A * 2/1975 Zwinge ..... 59/4
5,728,021 A * 3/1998 van Rooij et al. ..... 474/229
6,824,484 B2 * 11/2004 Greiter ..... 474/201
7,140,173 B2 * 11/2006 Van Rooij ..... 59/7

FOREIGN PATENT DOCUMENTS

| | | |
|---|---|---|
| DE | 197 27 845 A 1 | 1/1999 |
| EP | 1 579 933 A1 | 3/2004 |
| GB | 331093 | 6/1930 |
| JP | 2006-95583 | 4/2006 |
| JP | 2006-116562 | 5/2006 |
| JP | 2006-116563 | 5/2006 |

OTHER PUBLICATIONS

European Search Report dated Apr. 25, 2008.

* cited by examiner

*Primary Examiner*—David B Jones
(74) *Attorney, Agent, or Firm*—McGinn IP Law Group, PLLC

(57) ABSTRACT

A press-fitting apparatus includes a first retaining jig having a required number of pin insertion holes into which generally longitudinally half portions of pins and interpieces can be inserted, a second retaining jig having a required number of pin insertion holes into which one end portions of the pins and interpieces can be inserted, and pressing jigs each for pressing the link into a predetermined position relative to the pins and interpieces. In the press-fitting of the links, the press-fitting operation is divided into two steps, and in each of the two steps, the links are stacked from central portions of the pins and interpieces.

17 Claims, 4 Drawing Sheets

METHOD OF PRODUCING POWER TRANSMISSION CHAIN AND PRESS-FITTING APPARATUS USED IN SAID METHOD

BACKGROUND OF THE INVENTION

1. Field of the Invention

This invention relates to a method of producing a power transmission chain and a press-fitting apparatus used in this method, and more particularly to a method of producing a power transmission chain suitably used in a continuously variable transmission (CVT) of a vehicle such as an automobile and a press-fitting apparatus used in this method.

2. Related Art

As a continuously variable transmission for an automobile, there is known the type (chain type continuously variable transmission (as shown in FIG. 5) which comprises a drive pulley 2 having a fixed sheave 2*a* and a movable sheave 2*b* and operatively connected to an engine, a driven pulley 3 having a fixed sheave 3*b* and a movable sheave 3*a* and operatively connected to a drive wheel, and an endless power transmission chain 1 extending around the two pulleys. Each movable sheave 2*b*, 3*a* is moved toward and away from the corresponding fixed sheave 2*a*, 3*b* by a hydraulic actuator, and by doing so, the chain 1 is clamped by hydraulic pressure, and by this clamping force, a contact load is caused to develop between each pulley 2, 3 and the chain 1, and a torque is transmitted by a frictional force of this contact portion One known power transmission chain suited for such a continuously variable transmission comprises a plurality of links having pin passage portions, and a plurality of pins which interconnect the links arranged in a chain width direction, and each pin is fixed to the link by press-fitting. There is proposed in JP-A-2006-95583 a method of producing such a power transmission chain, in which a required number of pins are retained in a pattern corresponding to a final arrangement of the pins of the assembled chain such that the pins are disposed vertically and are arranged at a predetermined pitch. In this condition, the links are press-fitted one by one on the pins such that the links are stacked from lower end portions of the pins.

In the power transmission chain of this kind, the plurality of links arranged in the chain width direction are disposed symmetrically with respect to a centerline disposed centrally of the width of the chain. In the above conventional power transmission chain-producing method, the links are press-fitted on the pins in such a manner that the links are stacked from the lower end portions of the pins, and therefore the position of those links press-fitted at a final stage and disposed at the upper end portions of the pins is often considerably varied by the influence of precision of a plate thickness of the links, etc., so that the projecting amount of the pins from the row of links (arranged in the chain width direction) at one end portions of the pins is different from the projecting amount of the pins at the other end portions thereof. This variation in the projecting amount of the pins causes noises.

SUMMARY OF THE INVENTION

It is an object of this invention to provide a method of producing a power transmission chain which can prevent the increase of the difference in the projecting amount of pins between one end portions and the other end portions of the pins, and also to provide a press-fitting apparatus used in this method.

According to one aspect of the present invention, there is provided a method of producing a power transmission chain comprising a plurality of links, and a plurality of pins interconnecting the links arranged in a direction of a width of the chain, wherein each of the pins is fixed to the links by press-fitting; the method comprises:

a pin retaining step of retaining a required number of pins in a pattern corresponding to a final arrangement of the pins of the assembled chain such that the pins are arranged at a predetermined pitch; a first press-fitting step of successively press-fitting a generally one half of a required number of links, arranged in the chain width direction, to all of the pins over a range from longitudinally-central portions of the pins to one end portions thereof; a pin inverting step of disposing all of the pins, having the generally one half of the links press-fitted thereto, in an inverted manner such that the one end portions and other end portions of the pins are reversed;

and a second press-fitting step of successively press-fitting the remainder of the required number of links, arranged in the chain width direction, to all of the inverted pins over a range from the longitudinally-central portions of the pins to the other end portions thereof.

The expression "generally one half" means that it may be just a half, or the number of the links to be press-fitted in one of the first and second press-fitting steps may be smaller one to about three from the number of the links to be press-fitted in the other press-fitting step.

In the pin retaining step and the pin inverting step, the pins are supported vertically or horizontally. The press-fitting of the links is effected using a pressing machine, and the links may be press-fitted one by one or several at a time, or all of the links arranged in the chain width direction may be press-fitted simultaneously.

In the power transmission chain, in some cases, a clearance is formed between the adjacent links arranged in the chain width direction, and in other cases no such clearance is formed between the adjacent links. In the former case, the precision of the thickness of the links is beforehand measured, and a pressing position used when pressing the links is set to a predetermined value, and this positional accuracy is controlled. In the latter case, the press-fitting is carried out until the pressing force reaches a predetermined value (that is, the pressing force is fully applied). In either case, the press-fitting operation is divided into the two steps, and in each of the two steps, the links are stacked from the longitudinally-central portions of the pins, and by doing so, the projecting amount of the pins at one end portions thereof can be made equal to the projecting amount of the pins at the other end portions thereof. Preferably, the clearance between the adjacent links arranged in the chain width direction is set to 0 (zero). With this arrangement, there is produced a frictional force which can suppress a string vibration developing in the chain, and this solves a problem that vibrations and noises increase. And besides, since the projecting amount of the pins at the one end portions thereof is equal to the projecting amount of the pins at the other end portions thereof, the noise level is further improved, and also the durability is enhanced.

According to another aspect of the invention, there is provided a press-fitting apparatus for use in the production of a power transmission chain comprising a plurality of links, and a plurality of pins interconnecting the links arranged in a chain width direction, wherein each of the pins is fixed to the links by press-fitting; that said apparatus comprising:

a first retaining jig of a disk-shape having a required number of pin insertion holes into which generally longitudinally half portions of said pins can be inserted, respectively;

a second retaining jig of a disk-shape having a required number of pin insertion holes into which one end portions of said pins can be inserted, respectively; and a pressing jig for pressing each link into a predetermined position relative to said pins, wherein, after a generally one half of a required number of links, arranged in the chain width direction, are successively press-fitted by the pressing jig to all of said pins which are inserted into the pin insertion holes in the first retaining jig over a range from longitudinally-central portions of said pins to one end portions thereof, said pins having the generally one half of said links press-fitted thereto are inverted such that the one end portions and other end portions of the pins are reversed, and the one end portions of the pins are inserted into the pin insertion holes in the second retaining jig, and the remainder of the required number of links, arranged in the chain width direction, are successively press-fitted by the pressing jig to all of said inverted pins over a range from the longitudinally-central portions of said pins to the other end portions thereof.

The expression "generally longitudinally half portion" means that it may be just a longitudinally half portion or may be longer or shorter from this half portion by an amount corresponding to a thickness of one to about three links.

The retaining jigs and the pressing jig are made of carbon tool steel or alloy tool steel, and are mounted on a pressing machine or the like. The retaining jig is supported so as to be rotated about a center axis (for example, a vertical axis) relative to a link supply apparatus, and the pressing jig is supported so as to be moved along the center axis relative to the retaining jig. The pin insertion holes of the first retaining jig and the pin insertion holes of the second retaining jig are different in depth from each other (The pin insertion holes in the first retaining jig are equal to the length of the generally longitudinally half portions of the pins, while the pin insertion holes in the second retaining jig are equal to the projecting amount of the pins.), and are identical in transverse cross-section, and are disposed at the same pitch. The pin insertion holes are so formed as to retain the required number of pins in the pattern corresponding to the final arrangement of the pins of the assembled chain such that the pins are arranged at the predetermined pitch. Pin insertion holes in the pressing jig are so formed as to correspond respectively to the pin insertion holes in the retaining jig.

The above producing method and the above press-fitting apparatus are suited for producing various power transmission chains requiring the press-fitting, and are more suited for producing a power transmission chain comprising a plurality of links each having front and rear passage portions for the passage of pins therethrough, and a plurality of first pins and a plurality of second pins, wherein the first pins and the second pins are arranged in a forward-rearward direction, and interconnect the links arranged in a direction of a width of the chain in such a manner that the front passage portion of one link corresponds to the rear passage portion of other link, and the first pin and the mating second pin move relative to each other in rolling contact with each other so that the links can be bent relative to each other in a direction of a length of the chain, and one of the first pin and the mating second pin is fixed by press-fitting to the front passage portion of one link, and also is movably fitted in the rear passage portion of other link, while the other of the first pin and the mating second pin is movably fitted in the front passage portion of the one link, and also is fixed by press-fitting to the rear passage portion of other link. In this case, the press-fitting is effected at edge (upper and lower edges) of those portions of the passage portions disposed perpendicular to the direction of the length of the chain.

In the above power transmission chain, at least one of the first pins and the second pins contact pulleys, and power is transmitted by a frictional force. In the type of chain in which one of first pins and second pins contact pulleys when this chain is used in a continuously variable transmission, those pins which contact the pulleys are called "pins" and will hereinafter be referred to as "first pins", and those pins which will not contact the pulleys are called "interpieces or strips" and will hereinafter referred to as "second pins or interpieces".

Each link is made, for example, of spring steel or carbon tool steel. The material of the link is not limited to spring steel and carbon tool steel, and any other suitable steel such as bearing steel can be used. The link may be of the type (pillared type) in which the front and rear passage portions are defined respectively by two independent through holes, or may be of the type (non-pillared type) in which the front and rear passage portions are defined by a single through hole. As a material for the pins, suitable steel such as bearing steel is used.

In the power transmission chain-producing method and the press-fitting machine, the difference in the projecting amount of pins between one end portions and the other end portions of the pins is prevented from increasing, thereby reducing noises and also enhancing the durability.

DETAILED DESCRIPTION OF THE PREFERRED EMBODIMENTS

A preferred embodiment of the present invention will now be described with reference to the drawings. In the following description, the upper and lower sides correspond to the upper and lower sides in FIG. 2.

Figure 1:
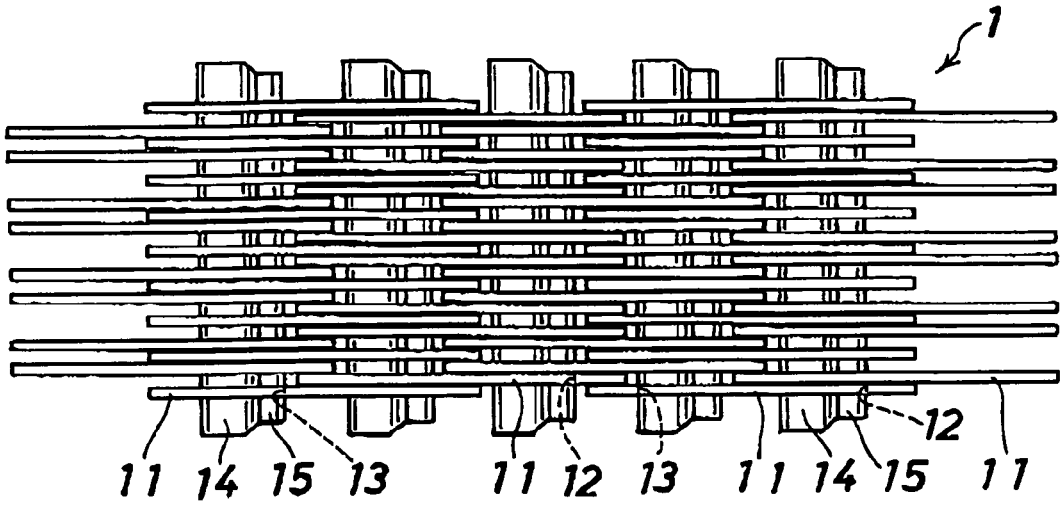
FIG. 1 is a plan view showing part of one example of a power transmission chain produced by a power transmission chain-producing method of the present invention.

FIG. 1 shows a part of a power transmission chain produced using a power transmission chain-producing method of the invention and a press-fitting apparatus of the invention. The power transmission chain 1 comprises a plurality of links 11 each having front and rear passage portions 12 and 13 spaced a predetermined distance from each other in a chain length direction, and a plurality of pairs of pins (first pins) 14 and interpieces (second pins) 15 which interconnect the links 11 arranged in a chain width direction so that the links 11 are bendably connected to each other in the chain lengthwise direction. The interpiece 15 is shorter than the pin 14, and each interpiece 15 and the mating pin 14 are opposed to each other in such a manner that the interpiece 15 is disposed at the front side, while the pin 14 is disposed at the rear side.

Three link rows each comprising a row of links 11 disposed in phase with one another in the chain width direction are arranged in an advancing direction (forward-rearward direction) to form one link unit, and a plurality of link units each comprising three link rows are interconnected in the advancing direction to form the chain 1. In this embodiment, one rink row comprising nine links 11 and two link rows each comprising eight links 11 jointly form one link unit.

Figure 2:
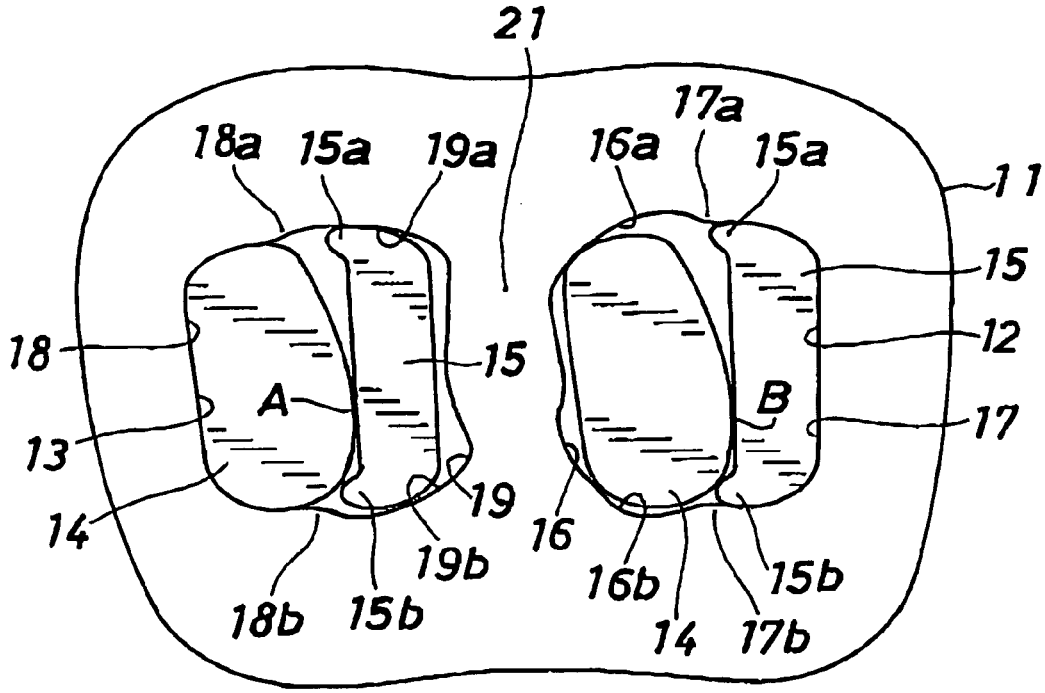
FIG. 2 is an enlarged side-elevational view of a link.

As shown in FIG. 2, the link 11 has a pillar portion 21 lying between the front passage portion 12 and the rear passage portion 13. The front passage portion 12 includes a pin movable portion 16 in which the pin 14 is movably fitted, and an interpiece fixing portion 17 to which the interpiece 15 is fixed. The rear passage portion 13 includes a pin fixing portion 18 to which the pin 14 is fixed, and an interpiece movable portion 19 in which the interpiece 15 is movably fitted.

Each pin 14 is larger in width (in the forward-rearward direction) than the interpiece 15, and projecting edge portions 15*a* and 15*b* are formed respectively at upper and lower edges of the interpiece 15, and extend toward the mating pin 14.

Regions designated respectively by reference characters A and B in FIG. 2 respectively indicate lines (points in cross-section) at which the pins 14 contact the respective interpieces 15 at a straight portion of the chain 1, and the distance between the regions A and B is the pitch.

For interconnecting the links 11 arranged in the chain width direction, the links 11 are stacked together in such a manner that the front passage portion 12 of one link 11 corresponds to the rear passage portion 13 of other link, and the pin 14 is fixed to the rear passage portion 13 of one link 11, and also is movably fitted in the front passage portion 12 of other link 11, while the interpiece 15 is movably fitted in the rear passage portion 13 of the one link 11, and also is fixed to the front passage portion 12 of other link 11. Each pin 14 and the mating interpiece 15 move relative to each other in rolling contact with each other so that the links 11 can be bent relative to each other in the chain lengthwise direction (the forward-rearward direction).

Upper and lower convex generally-arc-shaped holding portions 18*a* and 18*b* for holding the pin 14 fixed to the pin fixing portion 18 are formed at a boundary portion between the pin fixing portion 18 and the interpiece movable portion 19 of the link 11, and are continuous respectively with upper and lower concave generally-arc-shaped guide portions 19*a* and 19*b* of the interpiece movable portion 19. Similarly, upper and lower convex generally-arc-shaped holding portions 17*a* and 17*b* for holding the interpiece 15 fixed to the interpiece fixing portion 17 are formed at a boundary portion between the interpiece fixing portion 17 and the pin movable portion 16, and are continuous respectively with upper and lower concave generally-arc-shaped guide portions 16*a* and 16*b* of the pin movable portion 16.

A trace of a position of contact between the pin 14 and the interpiece 15 obtained when using the pin 14 as a reference is an involute of a circle, and in this embodiment the contact surface of the pin 14 has an involute shape (in cross-section) having a base circle with a radius Rb and a center M, and the contact surface of the interpiece 15 is a flat surface (having a straight cross-sectional shape). With this construction, when each link 11 shifts from a straight portion to a curved portion of the chain 1 or from the curved portion to the straight portion, the pin 14 in the front passage portion 12 moves within the pin movable portion 16 relative to the mating interpiece 15 held in the fixed condition while its contact surface moves in rolling contact (including slight sliding contact) with the contact surface of the interpiece 15. At this time, in the rear passage portion 13, the interpiece 15 moves within the interpiece movable portion 19 relative to the pin 14 held in the fixed condition while its contact surface moves in rolling contact (including slight sliding contact) with the contact surface of the pin 14.

In the above power transmission chain 1, the pins are repeatedly moved upward and downward, so that polygon vibrations develop, and this is the cause of noises. However, the pins 14 and the interpieces 15 move relative to each other in rolling contact with each other, and besides the trace of the position of contact between the pin 14 and the interpiece 15 obtained when using the pin 14 as a reference is the involute of the circle. With this construction, vibrations can be reduced, and noises can be reduced as compared with the case where the contact surfaces of the pin and the interpiece are both arc-shaped surfaces.

Figure 3:
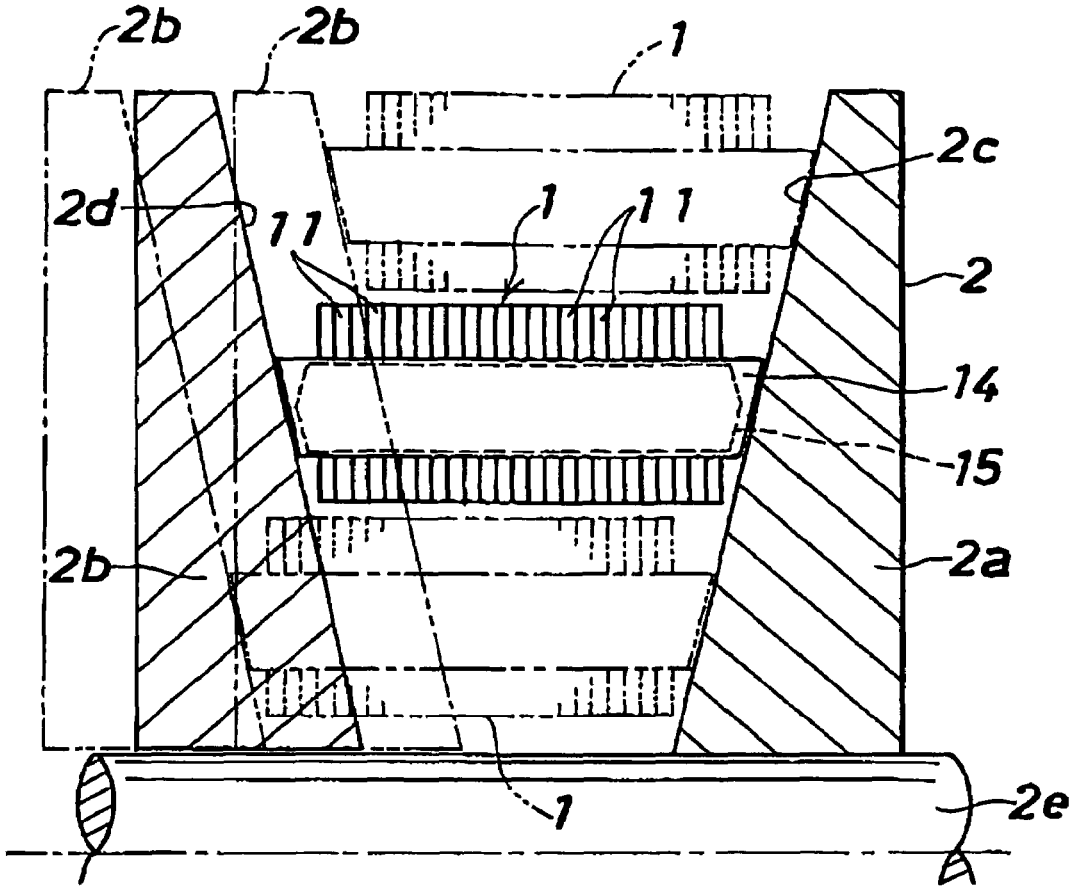
FIG. 3 is a front-elevational view showing a condition in which the power transmission chain is mounted on a pulley.
Figure 5:
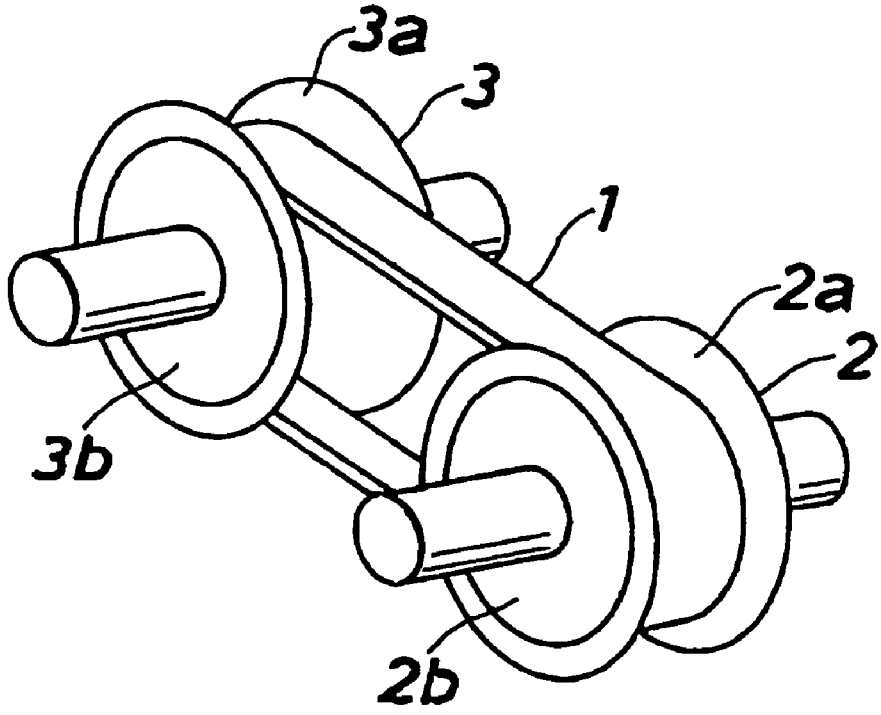
FIG. 5 is a perspective view showing a continuously variable transmission.

This power transmission chain 1 is used in a CVT shown in FIG. 5. At this time, the opposite end surfaces of each pin 14 are brought into contact respectively with conical sheave surfaces 2*c* and 2*d* of a fixed sheave 2*a* and a movable sheave 2*b* of a pulley 2 having a pulley shaft 2*e*, while the opposite end surfaces of each interpiece 15 do not contact the conical sheave surfaces 2*c* and 2*d*, as shown in FIG. 3. Power is transmitted by a frictional force due to this contact.

When the movable sheave 2*b* of the drive pulley 2 disposed in a position indicated by a solid line in FIG. 3 is moved toward the fixed sheave 2*a*, the effective diameter (that is, the diameter of a chain-moving path around the drive pulley) of the drive pulley 2) increases as indicated by dots-and-dash line in FIG. 3. On the other hand, when the movable sheave 2*b* is moved away from the fixed sheave 2*a*, the effective diameter of the drive pulley 2 decreases as indicated by a dots-and-dash line. Although not shown in the drawings, in a driven pulley 3, its movable sheave moves in an opposite direction relative to the movable sheave 2*b* of the drive pulley 2. When the effective diameter of the drive pulley 2 increases, the effective diameter of the driven pulley 3 decreases, and when the effective diameter of the drive pulley 2 decreases, the effective diameter of the driven pulley 3 increases. As a result, when a condition (initial value) in which the change gear ratio is 1:1 is used as a reference, there can be obtained a U/D (under-drive) condition in which the effective diameter of the drive pulley 2 is minimum while the effective diameter of the driven pulley 3 is maximum. Also, there can be obtained an O/D (overdrive) condition in which the effective diameter of the drive pulley 2 is maximum while the effective diameter of the driven pulley 3 is minimum.

For producing this power transmission chain 1, a required number of pins 14 and a required number of interpieces 15 are retained in position, and thereafter a required number of links 11 are successively press-fitted thereto. In this press-fitting operation, the upper and lower edge portions of the pin 14 are press-fitted respectively to the upper and lower edge portions of the pin fixing portion 18, and similarly the upper and lower edge portions of the interpiece 15 are press-fitted respectively to the upper and lower edge portions of the interpiece fixing portion 17. This press-fitting interference is 0.005 mm to 0.1 mm.

Figure 4A:
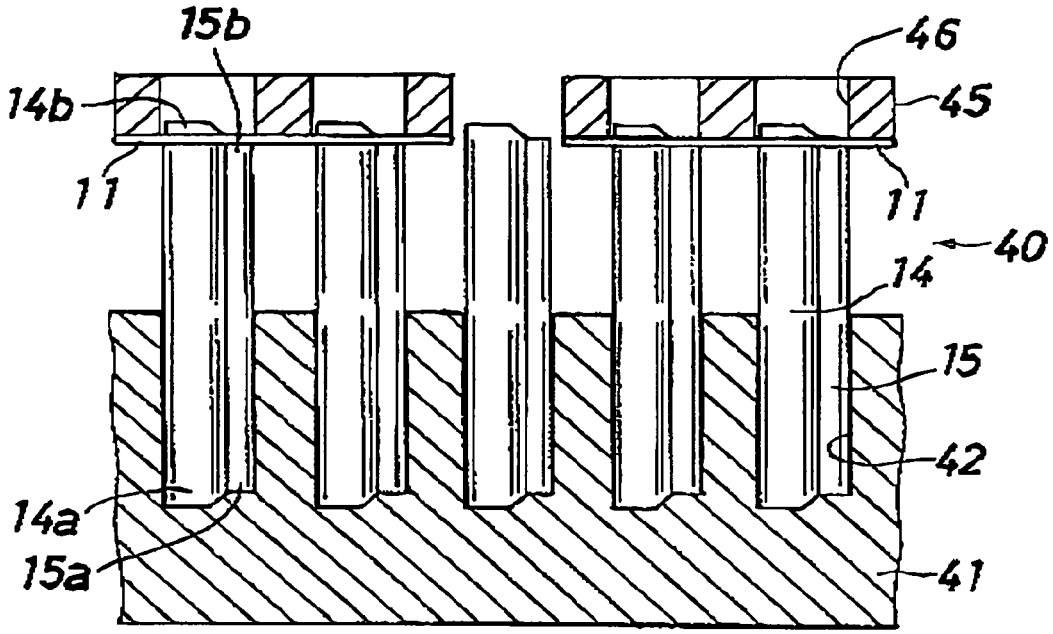
FIGS. 4A and 4B are vertical cross-sectional views showing the power transmission chain of the invention and a pressing jig of the invention.
Figure 4B:
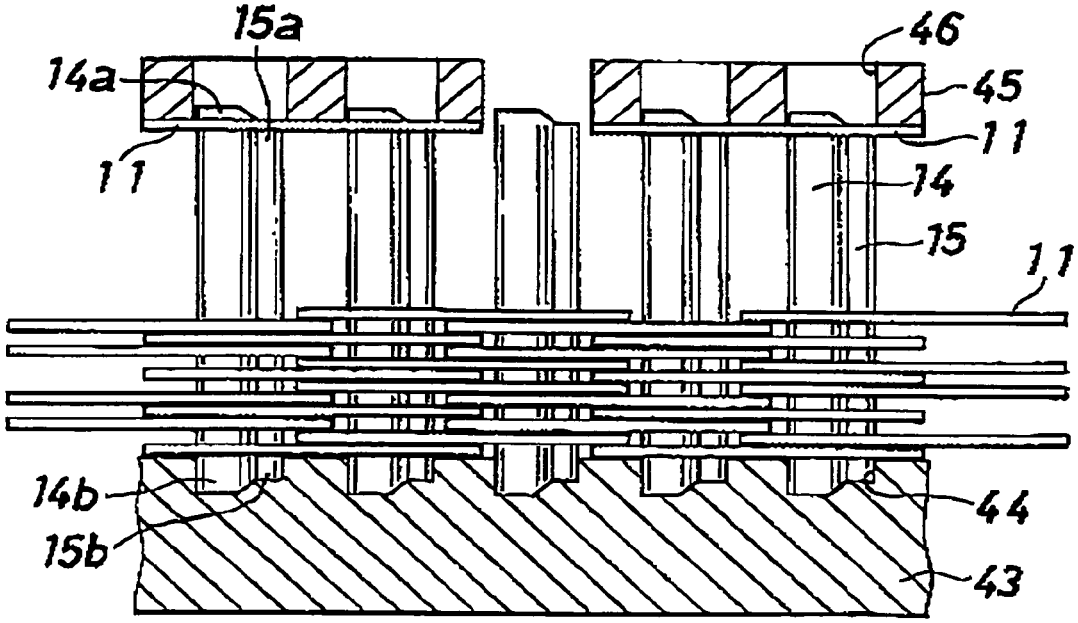

FIGS. 4A and 4B show the power transmission chain-producing method of the invention and the press-fitting apparatus of the invention used in this method. In the following description, although the upper and lower sides correspond to the upper and lower sides in the drawings, this is merely for convenience, and the arrangement may be changed such that the left and right sides in the drawings indicate the upper and lower sides.

The power transmission chain-producing method comprises a pin retaining step of retaining generally lower half portions of all of paired pins 14 and interpieces 15 (used for forming the chain 1) in a pattern corresponding to a final arrangement of the pins and interpieces of the assembled chain such that the paired pins and interpieces are arranged at a predetermined pitch, a first press-fitting step (see FIG. 4A) of successively press-fitting a generally one half of a plurality of links 11, arranged in a chain width direction, to all of the pins 14 and interpieces 15 over a range from longitudinally-central portions of the pins 14 and interpieces 15 to upper end portions 14*b* and 15*b* thereof, a pin inverting step of disposing all of the pins 14 and interpieces 15, having the generally one half of the links 11 press-fitted thereto, in an inverted manner such that the upper end portions 14*b* and 15*b* and lower end portions 14*a* and 15*b* of the pins 14 and interpieces 15 are reversed; and a second press-fitting step (see FIG. 4B) of successively press-fitting the remainder (generally the other half) of the plurality of links 11, arranged in the chain width direction, to all of the inverted pins 14 and interpieces 15 over a range from the longitudinally-central portions of the pins 14 and interpieces 15 to the upper end portions 14*a* and 15*a* thereof.

The press-fitting apparatus 40 comprises a first retaining jig 41 of a disk-shape which has a required number of pin insertion holes 42 for the insertion of generally longitudinally-half portions of the pins 14 and interpieces 15 therein and is used in the pin retaining step and the first press-fitting step, a second retaining jig 43 of a disk-shape which has a required number of pin insertion holes 44 for the insertion of the lower end portions 14*b* and 15*b* of the pins 14 and interpieces 15 and is used to retain the pins 14 and interpieces 15 in the pin inverting step and the second press-fitting step, and pressing jigs 45 each used in both of the first and second press-fitting steps to press each link 11 into a predetermined position relative to the pins 14 and interpieces 15.

Each pin insertion hole 42 in the first retaining jig 41 has a closed bottom, and a depth of this pin insertion hole 42 is equal to a generally half of the length of the pin 14 and interpiece 15. A bottom surface of the pin insertion hole 42 is stepped so that the end face of the pin 14 fitted in this pin insertion hole 42 projects beyond the end face of the interpiece 15. The pin insertion hole 42 is generally identical in transverse cross-sectional shape to the front and rear passage portions 12 and 13, and the pin 14 and the interpiece 15 can be inserted into and withdrawn from the pin insertion hole 42, and the pin 14 and the interpiece 15, when fitted in the pin insertion hole 42, will not move relative thereto.

Each pin insertion hole 44 in the second retaining jig 43 has a closed bottom, and a depth of this pin insertion hole 44 is equal to the projecting amount (amount of projection) of each of the pin 14 and the interpiece 15 from the outermost link 11 among the links 11 arranged in the chain width direction. A bottom surface of the pin insertion hole 44 is stepped so that the end face of the pin 14 fitted in this pin insertion hole 44 and the interpiece 15 can have the respective amounts of projection. The pin insertion hole 44 is generally identical in transverse cross-sectional shape to the front and rear passage portions 12 and 13, and the pin 14 and the interpiece 15 can be inserted into and withdrawn from the pin insertion hole 44, and the pin 14 and the interpiece 15, when fitted in the pin insertion hole 44, will not move relative thereto.

The pressing jigs 45 are used for press-fitting the links 11 one by one, and each pressing jig 45 has a generally rectangular plate-like shape and is slightly larger in size than the link 11. The pressing jig 45 has pin passage holes 46 which are formed therethrough and are generally identical in transverse cross-sectional shape to the front and rear passage portions 12 and 13. The pressing jig 45 is so fitted on the pins 14 and the interpieces 15 that it can move downward without interfering with the pins 14 and the interpieces 15 although the pressing jig 45 contacts the pins 14 and the interpieces 15.

The first retaining jig 41 can be rotated about a vertical axis First, all of the pins 14 and interpieces 15 used for forming the chain 1 are inserted into the pin insertion holes 42. Then, each link 11 is placed on the upper end portions of the pins 14 and interpieces 15, and the pressing jig 45 is moved downward. The depth of the pin insertion hole 42 is equal to a generally half of the length of the pin 14 and interpiece 15 as described above, and therefore the link 11 press-fitted first is located at a position disposed generally centrally of the width of the chain. Then, the links 11 are successively press-fitted. The amount of downward movement of the pressing jig 45 is so controlled that the link 11 of a first layer is not held in intimate contact with the link 11 of a second layer, but a predetermined clearance is formed between the links 11 of the adjacent layers. Thus, in the press-fitting operation using the first retaining jig 41, the generally one half of the plurality of links 11 arranged in the chain width direction are fitted to all of the pins 14 and interpieces 15 over the range from the generally longitudinally-central portions of the pins 14 and interpieces 15 to the upper end portions 14*b* and 15*b* thereof, thus finishing the first press-fitting step.

Then, the process proceeds to the pin inverting step and the second press-fitting step as shown in FIG. 4B. In these steps, first, all of the pins 14 and interpieces 15, having the generally one half of the links 11 press-fitted thereto, are inverted, and the upper end portions 14*b* and 15*b* thereof are inserted into the pin insertion holes 44 in the second retaining jig 43. Then, the link 11 is placed on the upper end portions 14*a* and 15*a* of the pins 14 and interpieces 15, and the pressing jig 45 is moved downward. At this time, the generally one half of the links 11 have already been fixed to the pins 14 and interpieces 15 by press-fitting, and therefore the link press-fitted first at this time is located at a position disposed generally centrally of the width of the chain. Then, the links 11 are successively press-fitted. The amount of downward movement of the pressing jig 45 is so controlled that a predetermined clearance is formed between the links 11 of the adjacent layers. Thus, in the press-fitting operation using the second retaining jig 43, the remainder of the links 11 are fitted to the pins 14 and interpieces 15 over the range from the generally longitudinally-central portions of the pins 14 and interpieces 15 to the upper end portions 14*a* and 15*a* thereof, thus finishing the assembling operation.

Thus, the step of stacking the links 11 in the direction from the lower end portions of the pins 14 and interpieces 15 toward the upper end portions thereof is effected not only once, but the press-fitting operation is divided into two steps, and in each of the two steps, the links 11 are stacked from the generally longitudinally-central portions of the pins 14 and interpieces 15 toward the upper end portions thereof. Therefore, the projecting amount of the pins 14 and interpieces 15 at one end portions thereof can be made equal to the projecting amount of the pins 14 and interpieces 15 at the other end portions thereof.

The links, the pins and the interpieces are not limited to the illustrated shapes thereof, and the above producing method and the press-fitting apparatus of the invention can be applied to any other suitable power transmission chain of the press-fitting type.

What is claimed is:

1. A method of producing a power transmission chain comprising a plurality of links, and a plurality of pins interconnecting the links arranged along a longitudinal axis of said pins, wherein each of the pins is fixed to the links by press-fitting, said method comprising:

retaining, in a first retaining jig, a required number of pins in a pattern corresponding to a final arrangement of said pins such that said pins are arranged at a predetermined pitch;

successively press-fitting approximately one half of a required number of links, arranged along the longitudinal axis of said pins, to said pins from approximately a center of said pins along the longitudinal axis of said pins to a first end portion of said pins from which said links are being pressed;

disposing, in a second retaining jig, said pins, having the approximate one half of said links press-fitted thereto, in an inverted manner such that the first end portion and a second end portion of the pins are reversed; and successively press-fitting a remainder of the required number of links, arranged along the longitudinal axis of said pins, to said inverted pins from about the center of said pins along the longitudinal axis of said pins to the second end portion of said pins from which said links are being pressed thereof.

2. A method of producing a chain according to claim 1, wherein said plurality of links comprise a front passage portion and rear passage portion which are defined by two independent through holes.

3. A method of producing a chain according to claim 1, wherein a link of said plurality of links is in contact with another link of said plurality of links along the longitudinal axis of the pin.

4. A method of producing a chain according to claim 1, wherein a space is disposed between adjacent links along the axis of the pin.

5. A method of producing a chain according to claim 2, wherein the front passage portion includes a movably-fitted pin and an interpiece pin having a length which is less than a length of said movably-fitted pin and being fixed in a pin fixing portion, and the rear passage portion includes a pin fixed in a pin fixing portion and an interpiece pin which is movably-fitted and has a length which is less than a length of said fixed pin.

6. A method of producing a chain according to claim 5, wherein the interpiece pin and the fixed pin move relative to each other in rolling contact with each other, with a trace of contact position between said fixed pin and said interpiece pin being an involute circle in reference to said fixed pin.

7. A method of producing a chain according to claim 1, wherein a projecting amount of the pins of the first end portion is equal to a projecting amount of the pins of the second end portion.

8. A method of producing a chain according to claim 1, wherein said successively press-fitting said approximately one-half of said required number of links comprises press-fitting said links to a predetermined point longitudinally along axis on said pins such that a predetermined clearance is formed between the links.

9. A press-fitting apparatus for use in the production of a power transmission chain comprising a plurality of links, and a plurality of pins interconnecting the links arranged along a longitudinal axis of said pins, wherein each of the pins is fixed to the links by press-fitting, said apparatus comprising:

a first retaining jig of a disk-shape having a plurality of pin insertion holes into which generally longitudinally half portions of said pins are insertable, respectively;

a second retaining jig of a disk-shape having a plurality of pin insertion holes into which a first end portion of said pins is insertable, respectively; and a pressing jig for pressing each link into a predetermined position relative to said pins, wherein, after approximately one half of a required number of links, arranged along the longitudinal axis of said pins, are successively press-fitted by the pressing jig to said pins which are inserted into the pin insertion holes in the first retaining jig over a range from longitudinally-central portions of said pins to the first end portions thereof, wherein said pins having the approximately one half of said links press-fitted thereto are inverted such that a first end portions and a second end portions of the pins are reversed, and the first end portions of the pins are inserted into the pin insertion holes in the second retaining jig, and wherein the remainder of the required number of links, arranged along the longitudinal axis of said pins, are successively press-fitted by the pressing jig to said inverted pins over a range from the longitudinally-central portions of said pins to the other end portions thereof.

10. A press-fitting apparatus according to claim 9, wherein said pressing jig presses multiple links simultaneously along the length of the chain.

11. A press-fitting apparatus according to claim 9, wherein said pressing jig presses multiple links simultaneously along the axis of the pins.

12. A press-fitting apparatus according to claim 9, wherein said pressing jig presses said links until a certain predetermined press depth is achieved.

13. A press-fitting apparatus according to claim 9, wherein said pressing jig presses said links until a predetermined pressure is achieved.

14. A press-fitting apparatus according to claim 9, wherein said pin insertion holes in said first retaining jig have a depth which is approximately equal to one-half of a length of said pins.

15. A press-fitting apparatus according to claim 9, wherein said pin insertion holes in said second retaining jig have a depth which is approximately equal to a length of the first end portions of said pins.

16. A press-fitting apparatus according to claim 9, wherein a depth of the pin insertion holes is equal to approximately one-half of the length of said pins, such that the first of said links which is press-fitted is disposed to approximately the longitudinally-central portions of said pins.

17. A press-fitting apparatus according to claim 9, wherein a pressing distance of the pressing jig is controlled such that a predetermined clearance is formed between the links of adjacent layers of said links.

* * * * *